US006851994B2

(12) United States Patent
Boatman et al.

(10) Patent No.: US 6,851,994 B2
(45) Date of Patent: Feb. 8, 2005

(54) DISCONNECTABLE MOORING SYSTEM AND LNG TRANSFER SYSTEM AND METHOD

(75) Inventors: L. Terry Boatman, Houston, TX (US); Arun S. Duggal, Houston, TX (US); Charles O. Etheridge, Bullard, TX (US); Jerry L. McCollum, Hempstead, TX (US)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 10/383,401

(22) Filed: Mar. 7, 2003

(65) Prior Publication Data

US 2003/0226487 A1 Dec. 11, 2003

Related U.S. Application Data

(60) Provisional application No. 60/362,876, filed on Mar. 8, 2002.

(51) Int. Cl.[7] ..... B63B 22/02
(52) U.S. Cl. ..... 441/4; 114/230.15
(58) Field of Search ..... 114/230.15, 230.14; 441/4, 5, 3

(56) References Cited

U.S. PATENT DOCUMENTS 4,114,556 A * 9/1978 Orndorf et al. ..... 114/230.14
4,226,204 A * 10/1980 Tuson ..... 441/3
4,352,596 A 10/1982 Hammett ..... 405/195
4,393,906 A * 7/1983 Gill ..... 141/387
4,530,302 A 7/1985 Pedersen ..... 114/230
4,568,295 A 2/1986 Poldervaart ..... 441/3
4,665,856 A 5/1987 Pedersen ..... 114/230
4,735,167 A 4/1988 White et al. ..... 114/230
6,244,920 B1 6/2001 de Baan ..... 441/3

FOREIGN PATENT DOCUMENTS

EP 0947464 10/1999
EP 0947464 A1 10/1999

* cited by examiner

*Primary Examiner*—Stephen Avila
(74) *Attorney, Agent, or Firm*—Gary L. Busy; Andrews Kurth LLP

(57) ABSTRACT

A disconnectable mooring system for connecting an LNG carrier vessel to a permanently moored LNG liquefaction process vessel in combination with an LNG offloading system. One end of a mooring yoke is suspended from a frame at the stern of the LNG process vessel. A male coupler is mounted to an opposite end of the mooring yoke via a universal joint. A female coupler is mounted on the LNG carrier vessel, with pull-in arrangements for pulling the LNG carrier vessel into position and the male coupler into selective coupling with the female coupler.

19 Claims, 4 Drawing Sheets

FIG.1
(PRIOR ART)
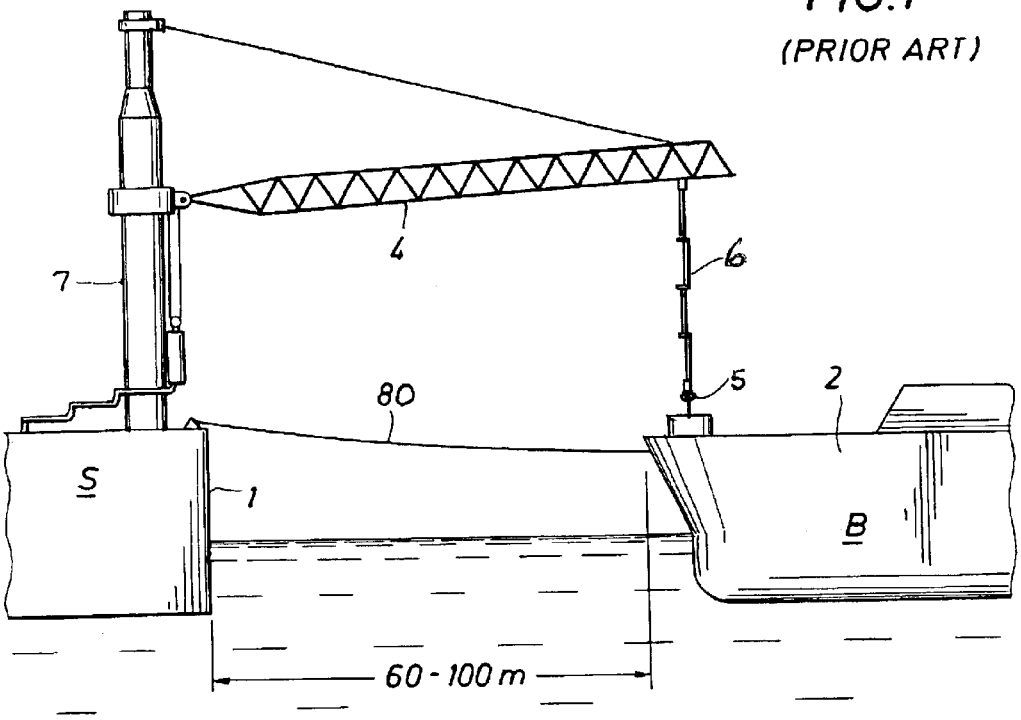
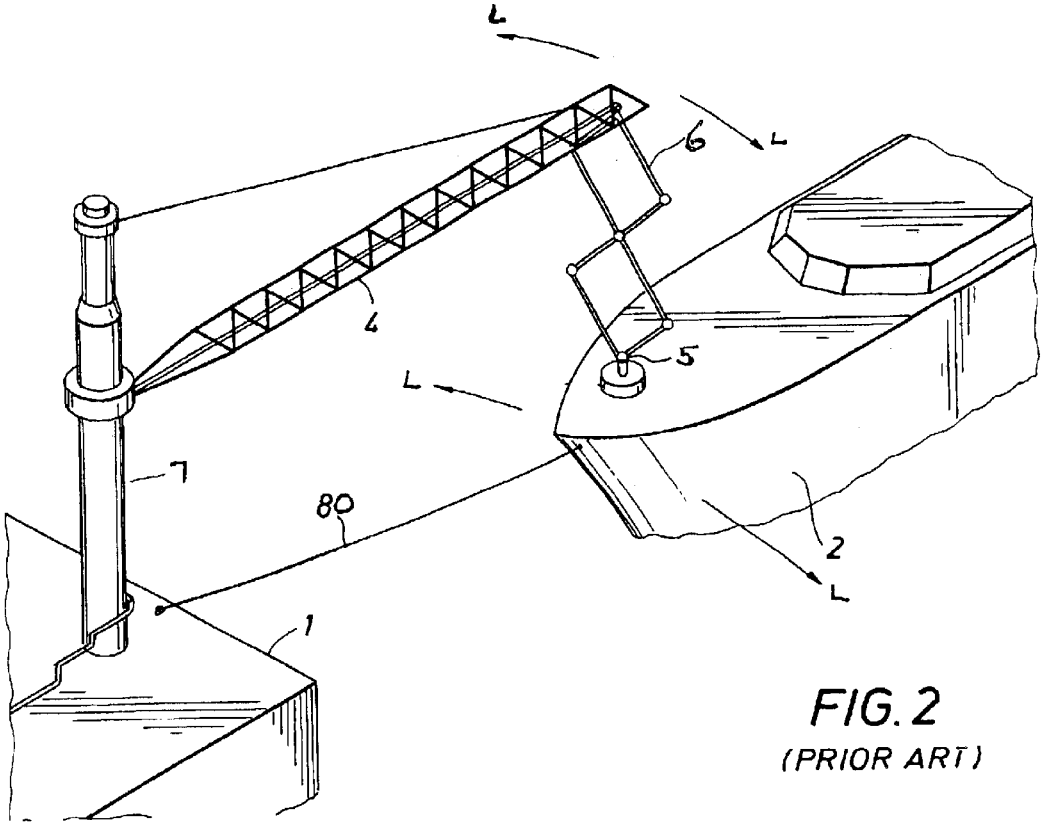
FIG. 2
(PRIOR ART)

DISCONNECTABLE MOORING SYSTEM AND LNG TRANSFER SYSTEM AND METHOD

CROSS-REFERENCE TO RELATED APPLICATION

This application is based upon provisional application Ser. No. 60/362,876 filed on Mar. 8, 2002, the priority of which is claimed.

BACKGROUND OF THE INVENTION

1. Field of the Invention

This invention relates generally to Floating Production Storage and Offloading vessels (FPSO's) where a turret is rotatably supported on the vessel and where the turret is fixed to the seabed by anchor legs so that the vessel can weathervane about the turret. In particular, this invention relates to stern offloading of a permanently moored LNG (Liquefied Natural Gas) liquefaction process vessel wherein pipelines on the seafloor bring natural gas to the permanently moored vessel. The gas is conducted from the seafloor to the vessel through flexible pipes (risers). An LNG plant on board the permanently moored vessel liquefies the gas, then large quantities of liquid gas are stored on board. Periodically, LNG carriers (shuttle tankers) arrive and load the liquefied gas for transport to distant ports. Temporary mooring connection and offloading to an LNG carrier vessel in offshore sea conditions requires highly reliable and safe equipment. Historically, most LNG loading operations are performed in mild environments in protected waters and at dockside. Performing this operation offshore between floating vessels is not known to have been done to date.

2. Description of the Prior Art

European patent application EP0947464A1 describes a fluid transfer system comprising a counterweighted transfer boom with coaxial fluid ducts mounted on the stern of a LNG storage vessel. The LNG storage vessel is also known by the term LNG process vessel and also LNG/FPSO. The drawings of this application show an LNG shuttle tanker (or "carrier") moored to the LNG storage vessel by means of a hawser. A disadvantage of this system concerns the method of mooring the LNG shuttle tanker with a flexible hawser to the LNG storage vessel. The relatively short reach of the fluid transfer boom makes it necessary to bring the LNG shuttle tanker very close to the storage vessel. This creates danger of collision of the two vessels, because the hawser does not restrict the forward motion of the LNG carrier. Therefore, a tugboat is required at all times at the LNG carrier stern to attempt prevention of collision.

FIGS. 1 and 2 of the drawings illustrate a prior art LNG transfer system 3, such as the FMC Technologies BTT system, with piping and flexible joint swivels connecting the stern S of LNG/FPSO vessel 1 to the bow B of LNG carrier 2. Hawser 80 endures the mooring force to hold LNG carrier 2 to the stern S of LNG/FPSO vessel 1. The hawser mooring system of FIGS. 1 and 2 can be disadvantageous in rough seas in that there is no restraint to prevent LNG carrier 2 from surging forward and colliding with LNG/FPSO vessel 1. Piping pantograph 5 is flexible and allows limited lateral motion of pantograph fluid connector 6 (see motion arrows "L" in FIG. 2), such as within a circle of 12 meters radius. As LNG carrier 2 sways laterally, crane boom 4 rotates automatically to follow the wide excursions of the bow B of LNG carrier 2 while connected to LNG carrier manifold 7. The system of FIGS. 1 and 2 requires a large separation distance, such as 60 to 100 meters to reduce the chance of collision of the vessels. The large separation distance requires a long and expensive crane boom 4.

U.S. Pat. No. 4,568,295 shows a yoke mooring system between a buoy and a moored vessel.

3. Identification of Objects of the Invention

A primary object of the present invention is to provide a disconnectable mooring device in combination with a fluid transfer arrangement to connect an LNG carrier (shuttle tanker) to an LNG process vessel (LNG/FPSO) that is intended for frequent connection and disconnection of the LNG carrier vessel in an offshore environment of at least Hs 2 meters significant wave height that causes relative motion between the two vessels.

Another object of the invention is to provide a disconnectable mooring system that temporarily moors an LNG carrier to an LNG process and storage vessel.

SUMMARY OF THE INVENTION

The objects identified above, as well as other features and advantages of the invention, are provided by a system which includes a disconnectable mooring arrangement and LNG transfer system between an LNG storage vessel and an LNG carrier. The mooring arrangement is characterized by a yoke with one end pivotable about horizontal axes of one of the vessels, e.g., the LNG storage vessel, with the yoke having an opposite end with a plug coupling arrangement. The plug coupling is arranged and designed to be pulled into a receptacle on the LNG carrier for selective coupling thereto. Liquid Natural Gas from the LNG storage holds is transferred to the LNG carrier by means of a fluid conduit and pantograph arrangement carried by a tower mounted boom which can be positioned to establish couplings on the LNG carrier.

BRIEF DESCRIPTION OF THE DRAWINGS

FIGS. 1 and 2 are prior art illustrations described above which illustrate an LNG carrier (shuttle vessel) moored to the stern of an LNG process vessel (LNG/FPSO for example) by means of a hawser and with a tower mounted boom and pantograph arrangement providing a fluid flowpath for LNG conduits from the process vessel to the carrier;

DETAILED DESCRIPTION OF A PREFERRED EMBODIMENT OF THE INVENTION

The illustrations of a preferred embodiment of the arrangements of FIGS. 3–5 according to the invention are described in connection with reference numbers as follows:

| | |
|---|---|
| 1 | LNG process vessel |
| 2 | LNG carrier |
| 3 | Mooring yoke |
| 4 | Boom |
| 5 | LNG pipe quick disconnect |
| 6 | Double pantograph pipe arrangement |
| 7 | Crane turntable |
| 8 | Roll axis bearing joint |
| 9 | Pitch axis joint |
| 10 | Third axis (vertical) joint |
| 11 | Hydraulic yoke connector |
| 12 | Pull-in cable or chain |
| 13 | Pull-in winch |
| 14 | Mooring bitt |
| 15 | LNG vapor return pipe |
| 16 | LNG loading pipe |
| 17 | Three axis universal joint |
| 18 | Two axis universal joint |
| 19 | Yoke support structure |
| 20 | Mooring hawser |
| 21 | Pickup line |
| 22 | Mooring winch |
| 23 | Link |
| 24 | Bow thruster |
| 25 | Shock absorbing cone |
| 26 | Center of gravity of yoke |
| 27 | Yoke arms |
| 28 | Bow extension |
| 29 | Sheave |
| 30 | Coupling head |
| 40 | Fluid conduit from LNG Process Vessel to coupling head |
| 41 | Fluid conduit from coupler to LNG carrier |
| 80 | Hawser |

Figure 3:
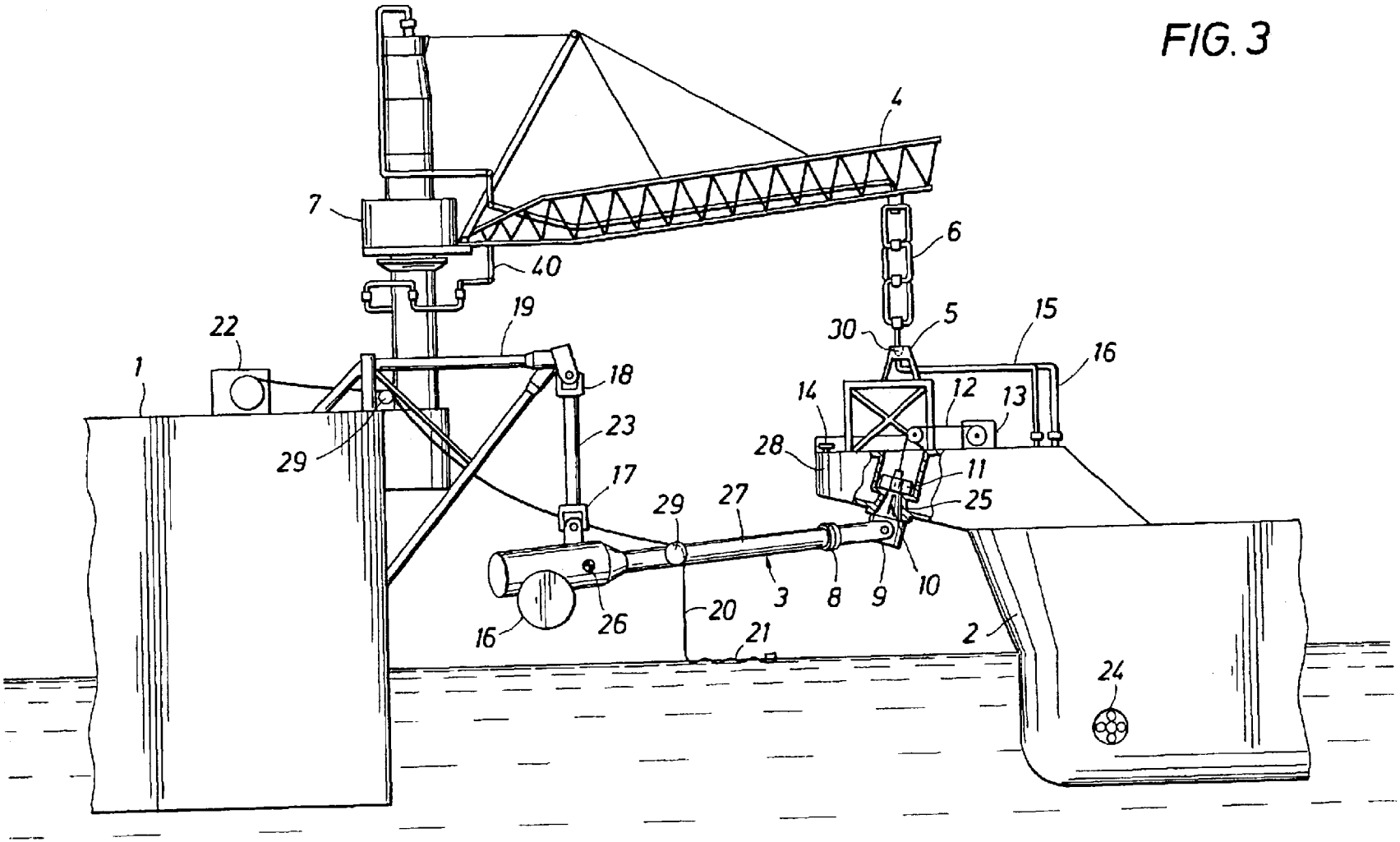
FIG. 3 is a side view of the mooring arrangement and LNG transfer structure according to the invention with a plug coupling at the end of the yoke secured within a female receptacle at the bow of the LNG carrier and shows a temporary mooring hawser in a slack position with a pickup line floating on the sea.
Figure 4:
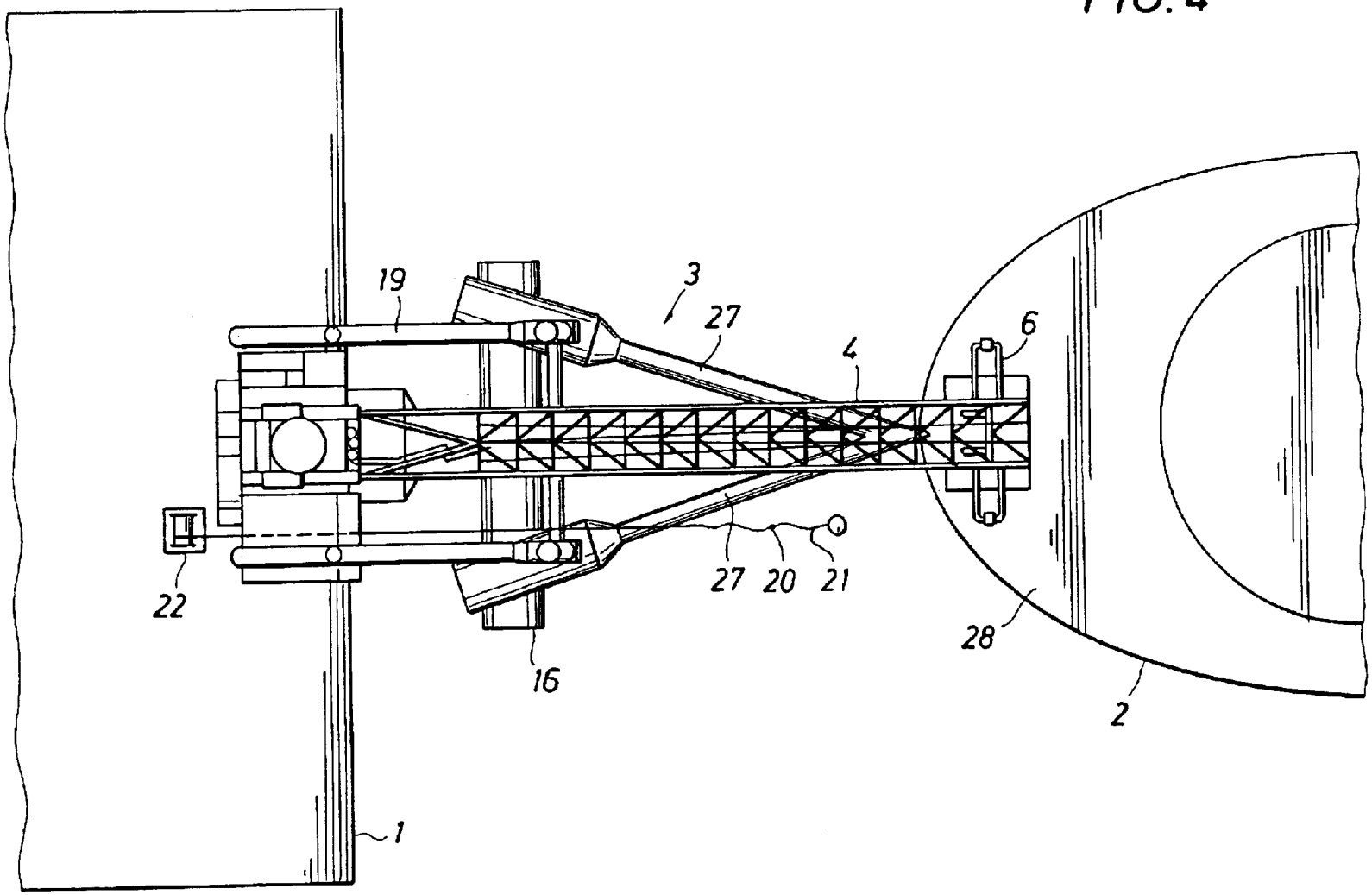
FIG. 4 is a top view of the arrangement of FIG. 3.

As illustrated in FIGS. 3 and 4, the LNG shuttle tanker 2 (LNG carrier) is temporarily moored to the stern of an LNG process vessel 1 (such as an LNG/FPSO) by means of mooring yoke arms 27 of yoke 3. The yoke arms 27 are suspended from a yoke support structure or frame 19 by vertical links 23 and two two axis universal joints 18. Two three axis universal joints 17 couple links 23 to yoke arms 27. A loading pipe 16 is secured to the inward ends of arms 27. The outward ends of arms 27 are coupled by a three axis universal joint to a shock absorbing cone 25 which is arranged and designed to be pulled up into a hydraulic yoke connector 11 on an extension 28 of the bow of LNG carrier 2.

The yoke 3, comprising arms 27, LNG loading pipe 16, and pivotable cone 25, is designed and arranged so that the center of gravity of the yoke is along a line 26 that is located a small distance outward of the connection of links 23 to arms 27 so that the yoke is generally balanced, but the outward end of the yoke rotates toward the sea when the cone 25 is disconnected from connector 11. Although not essential, cone 25 is constructed to provide flotation so that when the LNG carrier 25 is disconnected, the yoke 3 tips about the connection to links 23 with the outer end sloping toward the sea surface and with cone 25 providing flotation. Male shock absorbing connector cone 25 is connected to the ends 27 of yoke arms 27 by a three axis universal joint arrangement with a roll axis bearing joint 8, pitch axis joint 9 and vertical axis joint 10 thereof illustrated in FIGS. 3 and 5. A ball joint and hitch arrangement can alternatively be provided for connecting the arms 27 to the shock absorbing cone connector 25.

In operation, starting with the view of FIG. 3, a mooring hawser 20 is wound about mooring winch 22 on LNG process vessel 1 and extends over sheaves 29 with a pickup line 21 floating on the sea surface. When the vessel 2 is disconnected, the yoke 3 outer end with cone 25 floats on the sea surface.

Figure 5:
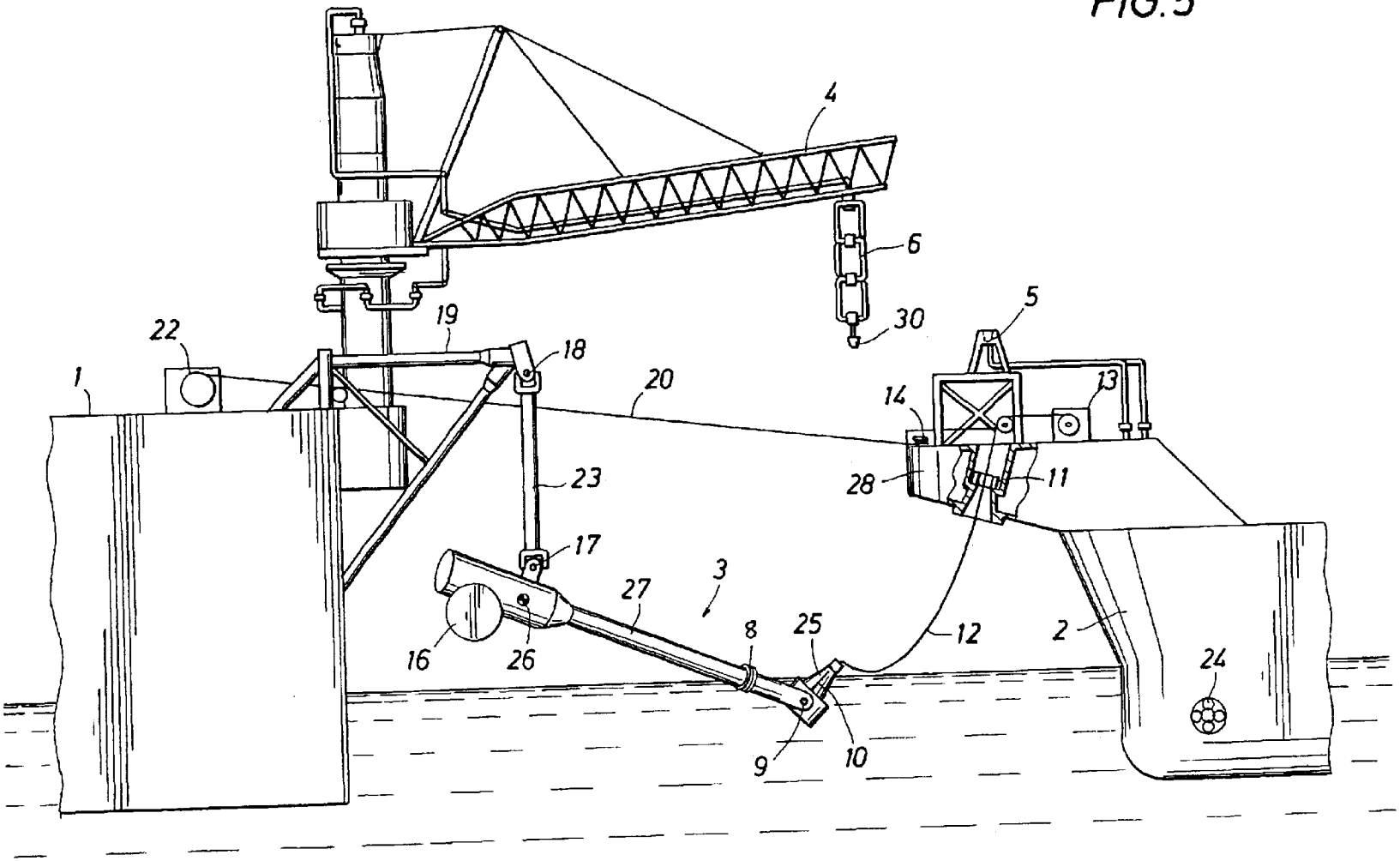
FIG. 5 is a side view of the mooring arrangement and LNG transfer structure with the plug coupling at the end of the yoke disconnected from the bow of the LNG carrier with the system illustrating the LNG conduits mounted on the pantograph disconnected from an LNG carrier bow coupling and a hawser connected between the LNG/FPSO and the LNG carrier.

When a vessel arrives for connection, as shown in FIG. 5, the hawser 20 is picked up and connected to a mooring bitt 14 on extension 28 of the LNG carrier vessel 2. The boom 4 and pantograph pipe arrangement 6 have been moved upwardly to provide clearance for the LNG carrier vessel 2 to be hauled into a position in proximity with the yoke 3. A pull-in cable or line 12 from pull-in winch 13 on extension 28 is passed through a passage of hydraulic yoke connector 11 mounted in extension 28 of the bow of LNG carrier 2. Bow thrusters 24 of the LNG carrier 2 provide position control for LNG carrier 2. The end of the pull-in cable 12 is secured to the cone 25. From the position of FIG. 5, the cone 25 is pulled into the connector 11. When pull-in is complete, the outer end of yoke 3 is fastened to the LNG carrier vessel 2 by the cone 25 being secured in hydraulic connector 11. Next, boom 4 is moved into position over the bow of the vessel 2, and the double pantograph pipe arrangement 6 is lowered into position for fluid coupling of coupling head 30 with LNG pipe quick connect/disconnect unit 5. The hawser 20 is disconnected from vessel 2 and the LNG carrier vessel is moored to the LNG process vessel 1 by means of frame 19 and mooring yoke 3 as shown in FIGS. 3 and 4.

When connected as illustrated in FIG. 3, an LNG fluid flow path is established from the LNG process vessel 1 via a crane turntable 7, boom 4, double pantograph pipe arrangement 6, LNG pipe connector 5 and an LNG loading pipe 16. An LNG vapor return pipe 15 from the LNG carrier 2 to the LNG carrier is also provided.

What is claimed is:

1. A combined mooring and fluid transfer arrangement between an LNG process vessel (1) and an LNG carrier (2) wherein, said mooring arrangement includes, a yoke (3) selectively disconnectably coupled between said LNG process vessel (1) and said LNG carrier (2) and having first and second ends with a non-disconnectable coupling arrangement at said first end, and a disconnectable coupling arrangement at said second end, and said fluid transfer arrangement includes, a boom (4) rotatably mounted on said LNG process vessel (1), a pantograph pipe arrangement (6) including a coupling head (30) carried by said boom, a first fluid conduit (40) running from said LNG process vessel via said boom to said pantograph pipe arrangement to said coupling head, an LNG pipe disconnectable coupler (5) mounted on said LNG carrier (2) which is arranged and designed to be selectively connected or disconnected with said coupling head (30), and a second fluid conduit (16) running from said disconnectable coupler to a second fluid conduit on said LNG carrier.

2. The combined mooring and fluid transfer arrangement of claim 1 wherein, said disconnectable coupling arrangement includes a first coupling member (25) mounted on said yoke (3) and a second coupling member (11) mounted on said LNG carrier (2); said first and second coupling members arranged and designed for selective connection with each other and disconnection from each other.

3. The combined mooring and fluid transfer arrangement of claim 2, wherein, said yoke (3) has two yoke arms (27) each having first and second ends, with said second ends of said yoke arms (27) connected to each other and coupled to said first coupling member (25) via a universal joint, with said first ends of said arms connected by a loading pipe (16), and said non-disconnectable coupling arrangement includes first and second suspension members (23) coupled between said LNG process vessel (1) and said first and second yoke arms (27) at locations of said first and second arms (27) which are between said loading pipe (16) and said first coupling member (25).

4. The arrangement of claim 3 wherein, said first and second suspension members (23) are respective first and second compression member links each connected at their top and bottom ends respectively to said LNG carrier (1) and to said first and second yoke arms (27) by universal joints (18, 17).

5. The arrangement of claim 3 wherein, said first and second suspension members (23) are connected at said locations on said first and second yoke arms (27) which are generally inward of a center of gravity line (26) of said yoke (3) so that said second ends of said yoke arms rotate toward sea surface when said first coupling member (25) is disconnected from said second coupling member (11).

6. The arrangement of claim 3 wherein, said first and second suspension members (23) are coupled to said LNG process vessel (1) via a frame (19) extending outwardly from said LNG process vessel (1).

7. The arrangement of claim 2 wherein, said first coupling member (25) is a male connection member, said second coupling member (11) is a female connection member and said disconnectable coupling arrangement further includes a winch (13) mounted on said LNG carrier (2) and a line (12) which extends from said winch (13) through said female connection member and is selectively coupled to said male connection member, wherein said winch (13), line (12) and female connection member are cooperatively designed so that said male connection member can be pulled into said female connection member for selective connection or disconnection.

8. The arrangement of claim 7 wherein, said second end of said yoke is arranged and designed to float on a sea surface when said first coupling member (25) is disconnected from said second coupling member (11).

9. A mooring arrangement between a first vessel (1) and a second vessel (2) comprising, a yoke (3) selectively disconnectably coupled between said first and second vessels, each designed to navigate on water said yoke (3) having first and second ends with a non-disconnectable coupling arrangement at said first end and a disconnectable coupling arrangement at said second, wherein said disconnectable coupling arrangement includes a first coupling member (25) mounted on said yoke (3) and a second coupling member (11) mounted on said second vessel (2), said first and second coupling members arranged and designed for selective connection with each other and for disconnection from each other, wherein said first coupling member (25) is connected to said yoke (3) by a universal joint, and wherein said first coupling member (25) is a male connection member, said second coupling member (11) is a female connection member and said disconnectable coupling arrangement further includes a winch (13) mounted on said second vessel (2) and a line (12) extends from said winch (13) through said female connection member and is selectively coupled to said male connection member, wherein said winch (13), line (12) and female connection member are cooperatively designed so that said male connection member can be pulled into said female connection member for selective coupling.

10. A mooring arrangement between a first vessel (1) and a second vessel (2) comprising, a yoke (3) selectively disconnectably coupled between said first and second vessels, each designed to navigate on water said yoke (3) having first and second ends with a non-disconnectable coupling arrangement at said first end and a disconnectable coupling arrangement at said second, wherein said disconnectable coupling arrangement includes a first coupling member (25) mounted on said yoke (3) and a second coupling member (11) mounted on said second vessel (2), said first and second coupling members arranged and designed for selective connection with each other and for disconnection from each other, wherein said first vessel is an LNG process vessel and, said second vessel is an LNG carrier, and wherein said yoke (3) has two yoke arms (27) each having first and second ends, with said second ends of said yoke arms (27) connected to each other and coupled to said first coupling member (25) via a universal joint, with said first ends of said arms connected by a loading pipe (16), and, said non-disconnectable coupling arrangement includes first and second suspension members (23) coupled between said LNG process vessel (1) and said first and second yoke arms (27) at locations of said first and second arms (27) which are between said loading pipe (16) and said first coupling member (25).

11. The mooring arrangement of claim 10 wherein, said first and second suspension members (23) are respective first and second compression member links each connected at their top and bottom ends respectively to said LNG carrier (1) and to said first and second yoke arms (27) by universal joints (18, 17).

12. The mooring arrangement of claim 10 wherein, said first and second suspension members (23) are connected at said locations on said first and second yoke arms (27) at a position longitudinally inward of a lateral center of gravity line (26) that passes through said first and second yoke arms (27), such that when said first coupling member (25) is disconnected from said second coupling member (11) said second ends of said yoke rotate toward sea surface.

13. The mooring arrangement of claim 12 wherein said second ends of said yoke arms include a floatation member.

14. The mooring arrangement of claim 13 wherein said floatation member is integral with said first coupling member (25).

15. A mooring arrangement between a first vessel (1) and a second vessel (2) comprising, a yoke (3) selectively disconnectably coupled between said first and second vessels, each designed to navigate on water said yoke (3) having first and second ends with a non-disconnectable coupling arrangement at said first end and a disconnectable coupling arrangement at said second, wherein said disconnectable coupling arrangement includes a first coupling member (25) mounted on said yoke (3) and a second coupling member (11) mounted on said second vessel (2), said first and second coupling members arranged and designed for selective connection with each other and for disconnection from each other, wherein said first vessel is an LNG process vessel and, said second vessel is an LNG carrier, and where said mooring arrangement further comprises a fluid transfer arrangement which includes, a boom (4) mounted on said LNG process vessel (1), a pantograph pipe arrangement (6) including a coupling head (30) carried by said boom, a first fluid conduit (40) running from said LNG process vessel via said boom to said pantograph pipe arrangement to said coupling head, an LNG pipe disconnectable coupler (5) mounted on said LNG carrier (2) which is arranged and designed to be selectively connected or disconnected with said coupling head (30), and a second fluid conduit (42) running from said disconnectable coupler to a second fluid conduit on said LNG carrier.

16. A method of mooring an LNG carrier (2) to an LNG process vessel (1) comprising the steps of, installing a yoke (3) which has yoke arms (27) each having first and second ends with said second ends of said yoke arms (27) connected to each other at a second yoke end and coupled to a first coupling member (25), with first and second suspension members (23) pivotably coupled with said LNG process vessel (1) and with said first ends of said yoke arms (27) at a first yoke end and installing a second coupling member (11) mounted on said LNG carrier (2), where said second end of said yoke is arranged and designed to float on a sea surface when said first coupling member (25) is disconnected from said second coupling member, connecting a hawser line (20) between said LNG process vessel (1) and said LNG carrier (2), providing a pull-in cable between said LNG carrier (2) and said first coupling member (25) on said yoke (3), and pulling said LNG carrier (2) into mooring position with said hawser line (20) while pulling said first coupling member (25) into selective connection with said second coupling member (11) while simultaneously pivoting said second yoke end with respect to said LNG process vessel (1), whereby said LNG process vessel (1) is disconnectably connected to said LNG carrier vessel (2) via said yoke (3).

17. The method of claim 16 further comprising the steps of, disconnecting one end of said hawser line (20), and providing a pick-up line (21) with a float device to said one end of said hawser line (20), and slacking said hawser line (20) so that said pick-up line (21) can be identified on said sea surface.

18. The method of claim 16 further comprising the steps of, disconnecting said first coupling member (25) from said second coupling member (11); and pivoting said second yoke end with respect to said LNG process vessel (1) until said second yoke end floats on said sea surface.

19. The method of claim 16 further comprising the steps of, establishing an LNG fluid conduit between said LNG process vessel (1) and said LNG carrier (2) after said first coupling member (25) has been pulled into selective connection with said second coupling member (11).

* * * * *